US010476141B2

(12) United States Patent
Marrero-Fontanez et al.

(10) Patent No.: US 10,476,141 B2
(45) Date of Patent: Nov. 12, 2019

(54) KA-BAND HIGH-GAIN EARTH COVER ANTENNA

(71) Applicant: United States of America as represented by the Administrator of NASA, Washington, DC (US)

(72) Inventors: Victor J. Marrero-Fontanez, Greenbelt, MD (US); Cornelis F. DuToit, Ellicott City, MD (US)

(73) Assignee: United States of America as represented by the Administrator of NASA, Washington, DC (US)

( * ) Notice: Subject to any disclaimer, the term of this patent is extended or adjusted under 35 U.S.C. 154(b) by 22 days.

(21) Appl. No.: 15/714,252

(22) Filed: Sep. 25, 2017

(65) Prior Publication Data

US 2019/0097309 A1 Mar. 28, 2019

(51) Int. Cl.

| | |
|---|---|
| ***H01Q 19/12*** | (2006.01) |
| ***H01Q 1/28*** | (2006.01) |
| ***H01Q 15/16*** | (2006.01) |
| ***H01Q 3/02*** | (2006.01) |
| ***H01P 1/17*** | (2006.01) |
| ***H01Q 13/02*** | (2006.01) |

(Continued)

(52) U.S. Cl.

CPC ..... *H01Q 1/288* (2013.01); *H01P 1/17* (2013.01); *H01P 1/171* (2013.01); *H01Q 1/125* (2013.01); *H01Q 3/02* (2013.01); *H01Q 3/04* (2013.01); *H01Q 13/0258* (2013.01); *H01Q 15/16* (2013.01)

(58) Field of Classification Search

CPC ..... H01Q 3/02; H01Q 15/16; H01Q 1/42; H01Q 1/44; H01Q 19/10; H01Q 21/06; H01Q 21/24; H01Q 19/08

See application file for complete search history.

(56) References Cited

U.S. PATENT DOCUMENTS 3,716,869 A * 2/1973 Gould, Jr. ..... H01Q 1/00 343/779

4,797,681 A * 1/1989 Kaplan ..... H01Q 13/0258 333/137

(Continued)

*Primary Examiner* — Dieu Hien T Duong

(74) *Attorney, Agent, or Firm* — Christopher O. Edwards; Bryan A. Geurts

(57) ABSTRACT

An antenna system includes a reflector, an offset feed horn and a support platform. The reflector has a reflector surface. The reflector and offset feed horn are attached to the support platform. The offset feed horn transmits RF microwave energy toward the reflector surface. The antenna system further includes a turntable which has a single rotation axis. The turntable rotates about the antenna rotation axis. The support platform is attached to the turntable such that the turntable rotates the support platform. The reflector surface has a perturbed paraboloid geometrical shape that reflects most RF microwave energy along a beam peak pointing direction. The reflector surface reflects RF microwave energy towards the earth's surface in such a manner that the reflected RF microwave energy illuminates a narrow strip of the earth's surface from nadir to a point near the earth's horizon with substantially constant intensity. The offset feed horn is oriented and positioned such that it points away from the beam peak pointing direction.

9 Claims, 8 Drawing Sheets

(51) Int. Cl.
*H01Q 1/12* (2006.01)
*H01Q 3/04* (2006.01)

(56) References Cited

U.S. PATENT DOCUMENTS

| | | | | | |
|---|---|---|---|---|---|
| 5,041,840 | A * | 8/1991 | Cipolla | H01P 1/173 | 343/700 MS |
| 5,398,035 | A * | 3/1995 | Densmore | H01Q 1/3275 | 343/713 |
| 5,949,370 | A * | 9/1999 | Smith | H01Q 1/288 | 342/354 |
| 2003/0038753 | A1 * | 2/2003 | Mahon | H01Q 13/06 | 343/781 CA |
| 2014/0266942 | A1 * | 9/2014 | Voss | H01Q 13/02 | 343/756 |

* cited by examiner

KA-BAND HIGH-GAIN EARTH COVER ANTENNA

ORIGIN OF INVENTION

The invention described herein was made by an employee of the United States Government, and may be manufactured and used by or for the Government for governmental purposes without the payment of any royalties thereon or therefor.

CROSS REFERENCE TO OTHER PATENT APPLICATIONS

None.

FIELD OF THE INVENTION

The present invention relates to a Ka band high-gain earth cover antenna.

BACKGROUND

Symmetrically shaped reflector antennas are known in the art. Due to the symmetry of axially symmetric reflector antennas, the feed horn pointing direction is along the symmetry axis of the reflector. An axially symmetric low gain reflector antenna such as an earth cover antenna is mechanically stable, but requires a high-power amplifier such as a traveling wave tube to provide enough system gain. A high-gain axially symmetric parabolic reflector antenna, while very compact in size, significantly reduces the power requirement, so that a relatively low power solid state power amplifier can be used instead. But an axially symmetric high-gain antenna requires a two-axis gimbal steering system that leads to a large mechanical movement volume. In order to accommodate the latter in space flight applications, the antenna is typically mounted on a boom to keep it away from the spacecraft, which further compromises mechanical stability. The two-axis gimbal steering mechanism and boom can be reduced to a more stable single rotation axis turntable by special shaping of the reflector, a technique also known in the art. The shaped reflector is kept symmetric with at least one plane of symmetry. Axially symmetric reflector antennas also suffer from aperture blockage, since the feed is at the center of the antenna aperture. High-gain, offset feed, reflector antennas, also well known in the art, solve the aperture blockage problem. In a high-gain, offset feed, shaped reflector, the offset feed horn is tilted in the shaped reflector symmetry plane. However, tilting the offset feed horn only in the shaped reflector symmetry plane can lead to relatively large reflector geometries. Large reflector antenna geometries are not suited for space applications due to strict limitations on weight and the limited available physical space on a spacecraft. What is needed is a new and improved antenna that eliminates the disadvantages of the aforementioned conventional antenna systems.

SUMMARY OF THE INVENTION

The antenna system of the present invention is a high-gain earth-cover antenna (HGECA) that is configured for Ka-band communications on spacecraft in low earth orbit (LEO). This antenna system includes a reflector, an offset feed horn and a support platform. The reflector is attached to a support post that is attached to the support platform. The offset feed horn is also attached to a support post that is attached to a support platform. The support platform is attached to a turntable so that the turntable can rotate the support platform. The turntable rotates the support platform only about the turntable rotation axis. The axis of the turntable points towards nadir. The reflector reflects a narrow beam of microwave radiation that points towards the earth's horizon and is shaped so that a narrow strip of the earth's surface from near the horizon to nadir is illuminated by the substantially same intensity of microwave radiation. The antenna system covers all ground stations that may occur in this narrow strip. The reflector is rotated only about the turntable rotation axis in order to link to other ground stations located in other directions. The polarization of the antenna reflector is circular thereby avoiding the problems associated with aligning linearly polarized antennas.

A feature of the high-gain earth cover antenna of the present invention is that the antenna's feed horn is tilted out of the symmetry plane. Although this configuration results in an asymmetric reflector, it allows the reflector size to be minimized for a given gain specification.

Another feature of the antenna system of the present invention is the use of a single-axis turntable. The reflector is attached to the single-axis turntable which rotates only about its vertical axis thereby simplifying steering control and reducing vibration and jitter.

Another feature of the antenna system of the present invention is the shaped surface of the reflector which directs most of the antenna beam energy towards the horizon while maintaining equal intensity on a strip all the way from nadir towards a point almost at the horizon.

Another feature of the antenna system of the present invention is an asymmetric offset feed horn configuration which completely eliminates aperture blockage and minimizes pattern ripple amplitude thereby allowing for a more efficient utilization of the shaped beam pattern.

In an exemplary embodiment, the antenna system of the present invention comprises a reflector, an offset feed horn and a support platform. The reflector has a reflector surface. The reflector and offset feed horn are attached to the support platform. The offset feed horn transmits RF microwave energy toward the reflector surface. The antenna system further includes a turntable which has a single rotation axis and is configured to rotate about the antenna rotation axis. The support platform is attached to the turntable such that the turntable rotates the support platform. The reflector surface has a perturbed paraboloid geometrical shape that reflects most RF microwave energy along a beam peak pointing direction. The reflector surface reflects RF microwave energy towards the earth's surface in such a manner that the reflected RF microwave energy illuminates a narrow strip of the earth's surface from nadir to a point near the earth's horizon with substantially constant intensity. The offset feed horn is oriented and positioned such that it points away from the beam peak pointing direction.

Other aspects and advantages of the invention will become apparent from the following detailed description taken in conjunction with the accompanying drawings which illustrate, by way of example, the principles of the described embodiments.

DESCRIPTION OF EXEMPLARY EMBODIMENTS

As used herein, the term "spacecraft" refers to any type of spacecraft used in space or space applications and includes satellites, CubeSats, space stations, capsules, rockets, probes, pods, planetary rovers and other space exploration vehicles.

Figure 1:
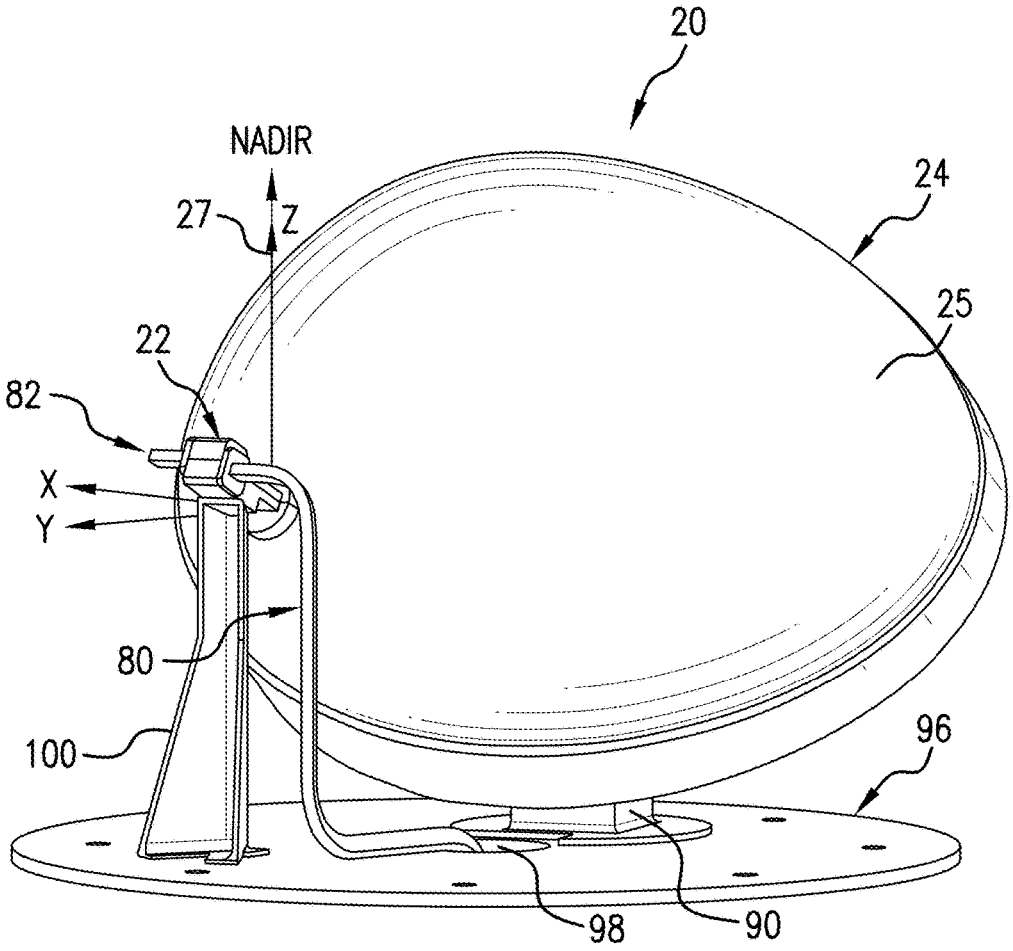
FIG. 1 is a perspective view of an antenna system in accordance with an exemplary embodiment of the present invention.

Referring to FIG. 1, there is shown an exemplary embodiment of the high-gain earth cover antenna system 20 of the present invention. Antenna system 20 includes offset feed horn 22 and shaped reflector 24. Feed horn 22 transmits RF microwave energy toward shaped reflector 24. Shaped reflector 24 includes reflector surface 25. The shape of reflector surface 25 is basically a paraboloid that is perturbed to divert a small portion of the radiation energy towards nadir and while maintaining substantially equal or constant radiation intensity on a strip all the way from nadir towards a point almost at the horizon. Reflector surface 25 reflects most of the RF microwave radiation in a direction referred to as the "beam-peak pointing direction". Feed horn 22 is offset such that it points away from the beam-peak point direction so that feed horn 22 does not block any of the RF microwave radiation reflected by reflector surface 25. Stated another way, feed horn 22 points or tilts out of the plane defined by the nadir direction and the beam peak point direction. The offset feed horn 22 configuration results in an asymmetric reflector surface 25. The asymmetry of reflector surface 25 allows the reflector size to be minimized for a given gain specification. In order to facilitate understanding of the orientation of reflector 24, nadir is indicated by reference number 27 and reference lines indicating the x, y and x axes are shown in FIG. 1.

Figure 2A:
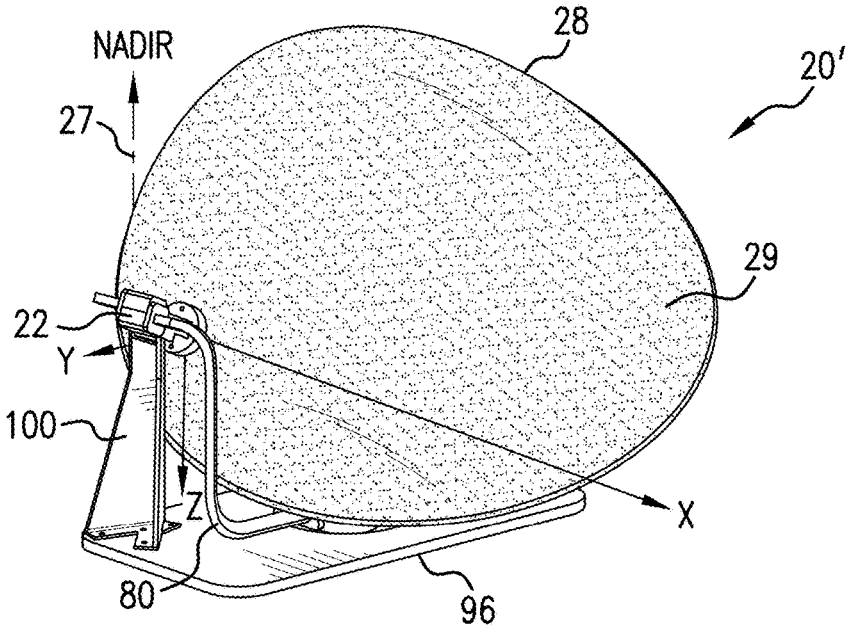
FIG. 2A is a perspective view of an antenna system in accordance with another exemplary embodiment of the present invention wherein the reflector is fabricated from an electrically conducting composite material, the view showing a front surface of the reflector.
Figure 2B:
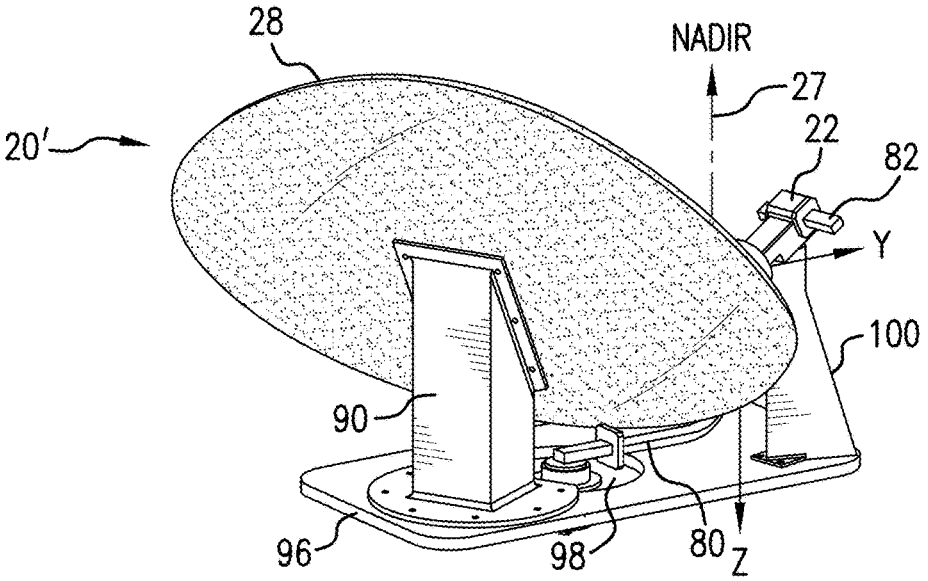
FIG. 2B is another perspective view of the antenna system of FIG. 2A, the view showing a rear surface of the reflector.
Figure 2C:
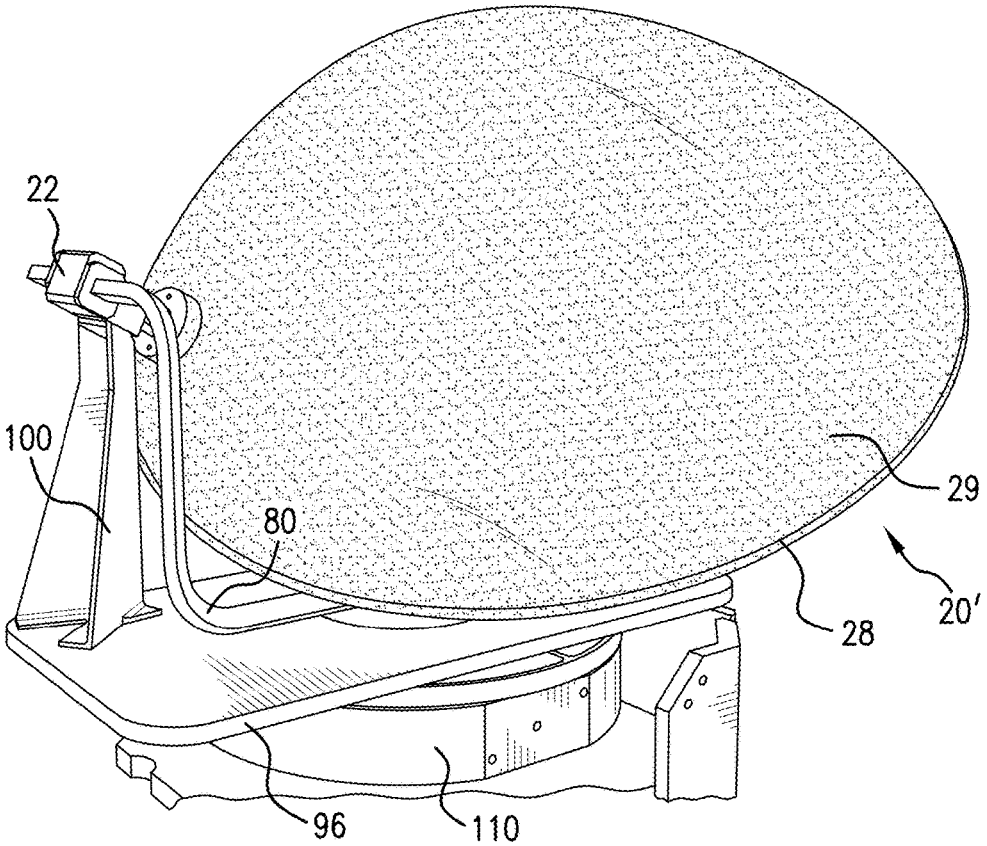
FIG. 2C is perspective view of the antenna system of FIG. 2A attached to a turntable.

Referring to FIG. 1, in an exemplary embodiment, reflector surface 25 is made from a metallic coating made from a metal having good electrical conduction properties, such as aluminum, copper, gold and silver. Other suitable metals may be used as well. Since reflector surface 25 is used with microwave frequencies, reflector surface 25 needs only a thin electrically conducting layer for proper operation. In one embodiment, gold is used as the electrically conducting layer due to its chemical stability. In another embodiment, aluminum is used as the electrically conducting layer due to its low cost, low weight and good thermal conductivity. FIGS. 2A and 2B show another exemplary embodiment of the invention. Antenna system 20' includes reflector 28. Reflector 28 is fabricated from a thermally stable, electrically conducting composite material and includes reflector surface 29. Suitable electrically conductive materials include thin film and nano-enabled conductive composites and conductive carbon fiber-reinforced plastic. In order to facilitate understanding of the orientation of reflector 28, reference lines indicating the x, y and x axes are shown in FIGS. 2A and 2B.

Figure 3:
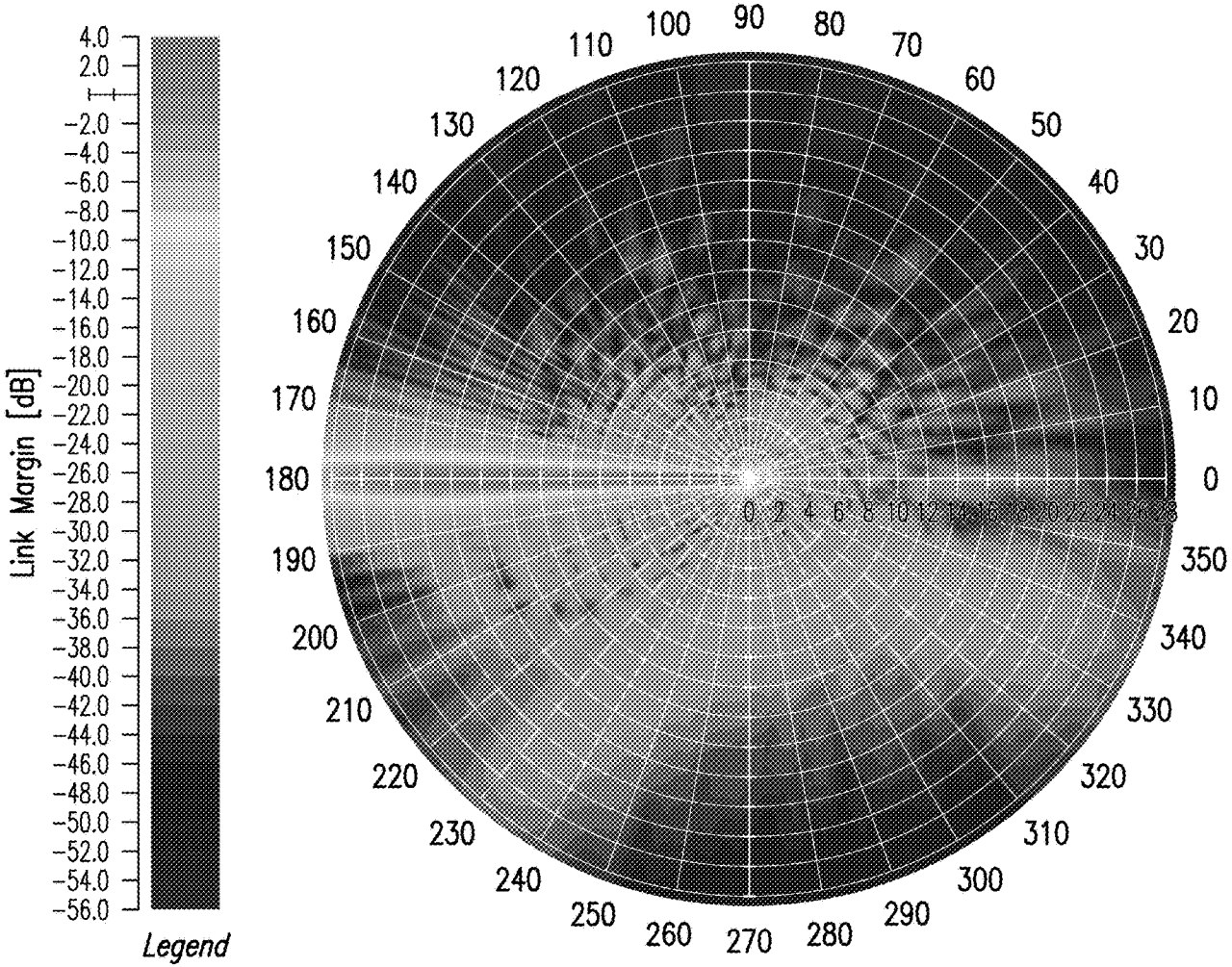
FIG. 3 illustrates an example of the radiation intensity of the earth's surface resulting from the antenna system of the present invention, the radiation intensity being expressed as a link margin contour pattern.
Figure 4:
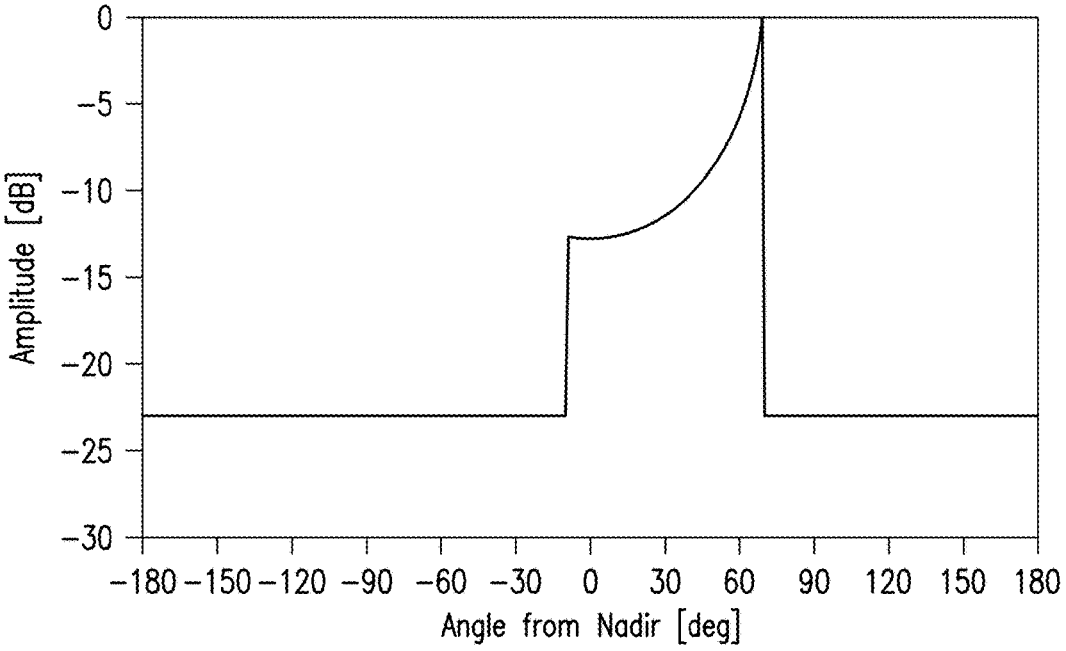
FIG. 4 illustrates ideal antenna radiation wherein gain is a function of the angle from nadir.
Figure 5A:
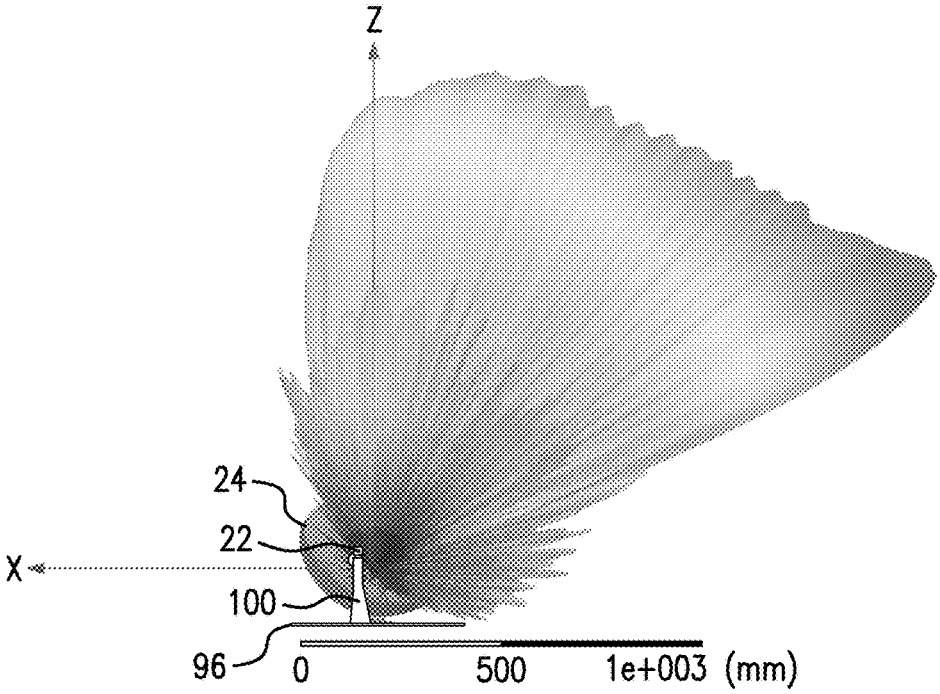
FIG. 5A illustrates a three-dimensional radiation pattern of the antenna system of the present invention, the 3D radiation pattern being shown in a spherical configuration.
Figure 5B:
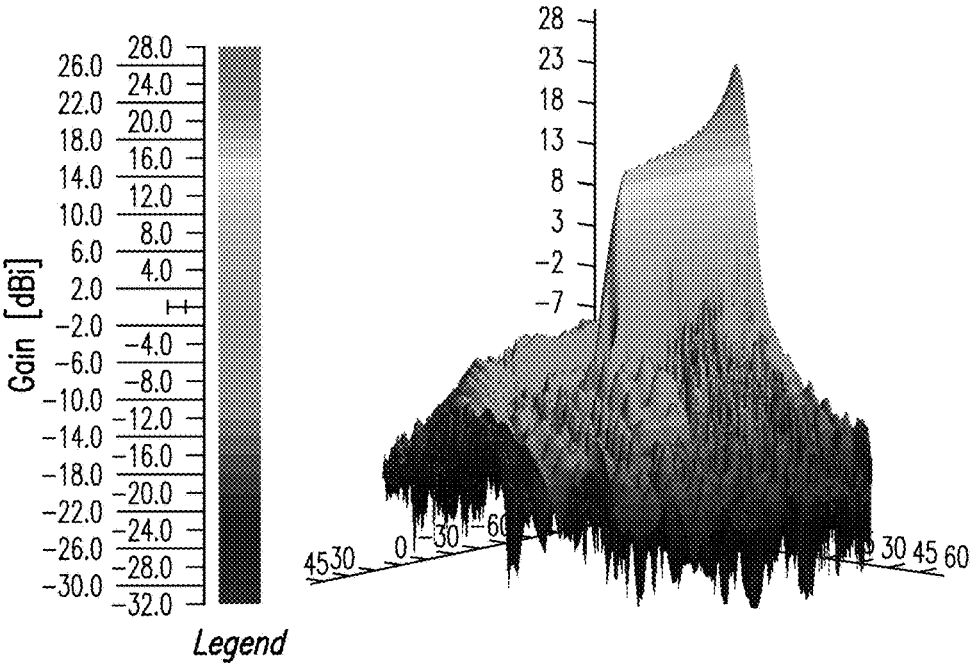
FIG. 5B illustrates a three-dimensional radiation pattern of the antenna system of the present invention, the 3D radiation pattern being shown in a rectangular configuration.

As used herein, the term "transmit mode" refers to an operational mode of the antenna system 20 wherein feed horn 22 is the transmitting source. The "receive mode" performance is by reciprocity the same as the transmit mode performance. In transmit mode, the feed horn 22 illuminates the reflector 24 with RF microwave energy. In response, reflector surface 25 reflects the microwave radiation down to the earth's surface. Reflector surface 25 is curved in such a way that the illumination intensity on the earth's surface is substantially constant along a narrow strip from nadir to a point close to the horizon. This is illustrated by the link margin contour pattern of FIG. 3. In the contour pattern of FIG. 3, it is assumed there is a 4 dB margin along the center line of the illuminated strip. The radial coordinate (distance from the center of the plot) represents units of 100 km from nadir on the earth's surface. The angular coordinate represents the azimuth angle $\phi$. In this example, the earth's horizon as seen from a satellite at a height of 708 km is about 2870 km from nadir. Thus, a substantial portion of the radiation energy emanating from feed horn 22 is diverted towards the areas near the horizon since those areas are farthest away and experience significant signal attenuation. FIG. 4 shows the ideal radiation pattern shape within the plane in which it is pointing. Outside the aforesaid plane, the pattern levels drops away causing it to be "fan-shaped" with one end much stronger and directed towards the horizon (which is typically about 65° from nadir, depending on the orbital height), and the weaker end directed towards nadir as shown by the 3-D radiation patterns shown in FIGS. 5A and 5B. In FIG. 5A, the 3-D radiation pattern is shown in spherical configuration wherein the gain in angular direction ($\phi$, $\theta$) is represented by the distance of the plot from the source. In FIG. 5B, the 3-D radiation pattern is shown in rectangular configuration wherein angular directions ($\phi$, $\theta$) are mapped to (x, y) with the gain being represented as the height z above the x,y plane.

Figure 6A:
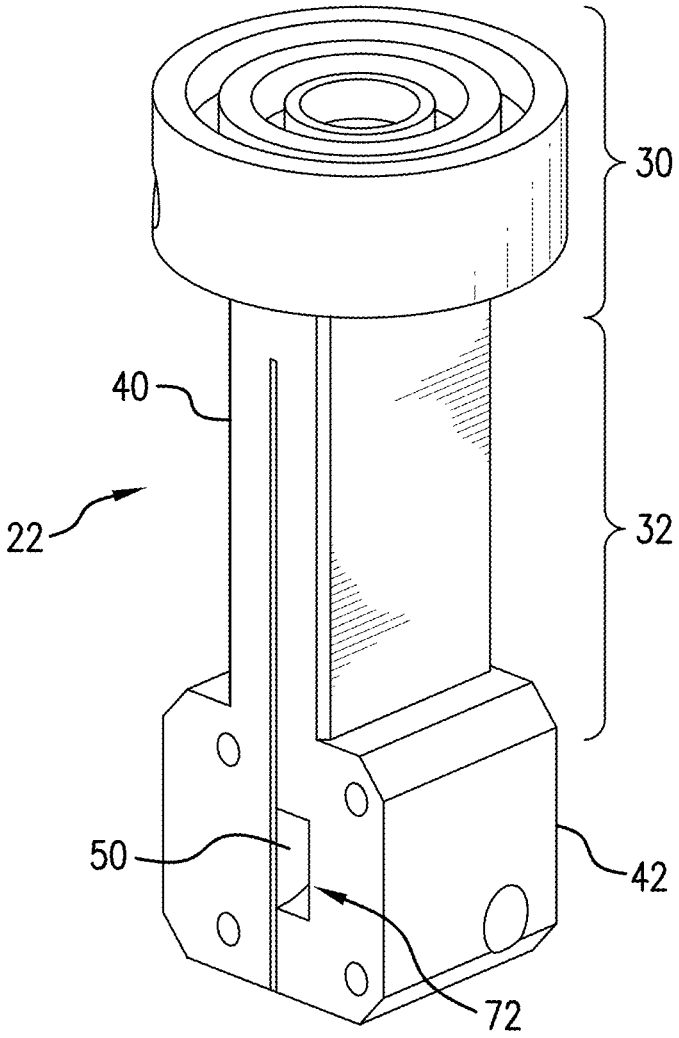
FIG. 6A is a perspective view, in elevation, of microwave feed horn shown in FIG. 1.
Figure 6B:
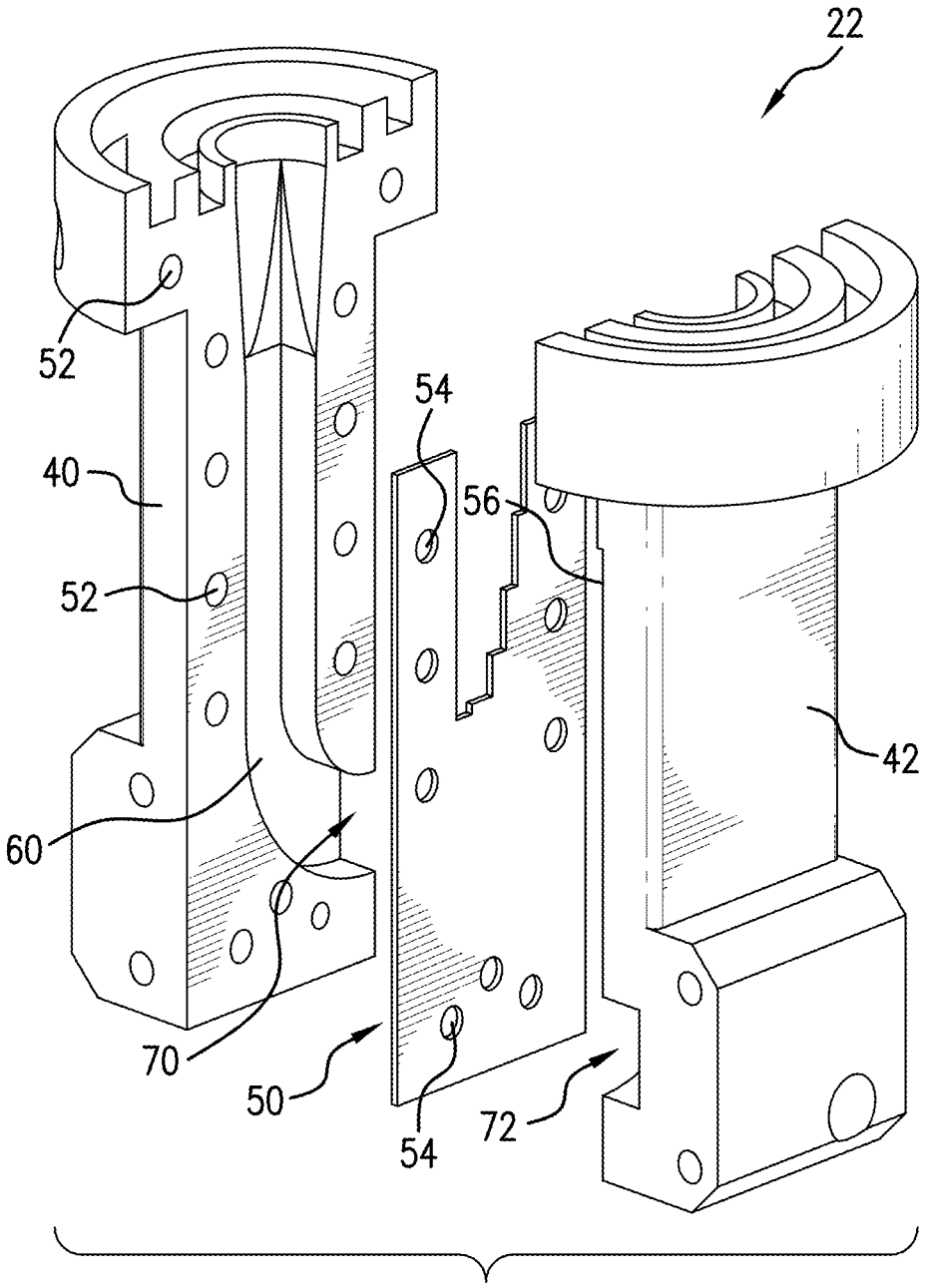
FIG. 6B is an exploded, perspective view, of the microwave feed horn.

Referring to FIGS. 6A and 6B, there is shown feed horn 22 in detail. Feed horn 22 includes horn section 30 and polarizer section 32. Feed horn 22 comprises two half sections 40 and 42 that are removably attached together. Sections 40 and 42 are made from metal. Suitable metals include gold, silver, copper and aluminum. Feed horn 22 includes polarizer fin 50 that is sandwiched between sections 40 and 42. Section 40 has screw holes 52 that receive corresponding screws (not shown). In an exemplary embodiment, section 42 includes threaded screw inlets (not shown) that are configured to engage the screws that are inserted through screw holes 52 of section 40. Polarizer fin 50 includes holes 54 that are aligned with the screw holes 52 in section 40 and the threaded screw inlets (not shown) in section 42. This configuration allows sections 40 and 42 to be connected together with polarizer fin 50 sandwiched therebetween. Section 42 includes stepped recess 56 that is shaped to receive polarizer fin 50. Section 40 includes channel 60 formed therein which is one half of the waveguide that is formed when sections 40 and 42 are attached together. Similarly, section 42 includes a corresponding channel (not shown) formed therein which is the second half of the waveguide that is formed when sections 40 and 42 are attached together. Connecting sections 40 and 42 together forms waveguide ports 70 and 72. Waveguide ports 70 and 72 are isolated with only insignificant amounts energy coupling from one waveguide port to the other. Waveguide port 70 produces right-hand circular polarization (RHCP) and waveguide port 72 produces left-hand circular polarization (LHCP). As shown in FIGS. 1, 2A, 2B and 2C, feed waveguide 80 is joined or attached to feed horn 22 so that microwave energy travels into waveguide port 72 and through the internal waveguide formed when sections 40 and 42 are attached together. Load termination device 82 is disposed within waveguide port 70. Load termination device 82 is well known in the art and therefore, is not discussed in detail herein. The other end of feed waveguide 80 is connected to a RF microwave transmitter and/or receiver (not shown) that is on the spacecraft.

Referring to FIG. 1, antenna system 20 includes support platform 96. Support post 90 is attached to support platform 96. Reflector 28 is attached to support post 90. Support post 100 is also attached to support platform 96. Offset feed horn 22 is attached to support post 100. Feed waveguide 80 extends through opening 98 in support platform 96 and is connected to offset feed horn 22. Antenna system 20 includes turntable 110 (see FIG. 2C) which has a single rotation axis. Support platform 96 is attached to turntable 110 such that turntable 110 rotates support platform 96. Turntable 110 is configured or adapted to be connected to a spacecraft. Antenna system 20 does not utilize a two-axis gimbal pointing system as compared to conventional high gain antennas that use a two-axis-gimbal pointing system that is supported by a special boom. As a result of this single-axis rotation feature, antenna system 20 is significantly more stable than the conventional two-axis gimbal system.

Antenna system 20 may utilize a low power, solid state power amplifier (S SPA) to provide the required gain while minimizing power consumption.

Reflector 24 was used in a 26.5 GHz application. Reflector 24 was about 40 cm×32 cm and yielded 28 dBi peak gain at 26.5 GHz. This is in stark contrast to a conventional omnidirectional earth cover antenna operating at the same frequency with a significantly larger 60 cm diameter reflector wherein the peak gain is only about 10 dBi.

Feed horn 22 was used in a 26.5 GHz application. Feed horn 22 had a height of about 60 mm. The useful radiation angular spread was about 65° from boresight wherein the radiation level was about 13 dB below peak.

Antenna systems 20 and 20' have several advantages and provide many benefits. Antenna systems 20 and 20' require only a single axis of rotation unlike conventional high gain antennas that utilize a two-axis gimbal pointing system supported by a special boom. Hence, antenna systems 20 and 20' are significantly more stable than the conventional two-gimbal antenna system. Antenna systems 20 and 20' also require significantly less power to operate than a conventional omni-directional antenna which may require an order of magnitude higher microwave power output. In an exemplary embodiment, antenna systems 20 and 20' require about 10 W for control and microwave amplifier power requirements. Another advantage of antenna systems 20 and 20' over conventional omni-directional earth cover antennas is that antenna systems 20 and 20' do not suffer from any aperture blockage effects. This allows the radiation pattern to follow the ideal curve much more closely. As a result, minimal pattern energy is wasted in keeping the pattern strength above the minimum allowed gain thereby resulting in higher antenna efficiency.

Antenna systems 20 and 20' provide high gain, have low power requirements and exhibit minimal vibration risk which makes these antenna systems well suited for spacecraft missions supporting sensitive scientific instruments. The unique design of antenna systems 20 and 20' enable these antenna systems to operate with high data-rates in the Ka-band frequencies used for Earth Observing (EO) missions at Low Earth Orbit (LEO) that have strict jitter requirements. Strict jitter requirements would automatically disqualify a conventional high-gain antenna with a dual-axis gimbal system due to the jitter caused by the dual-axis gimbal system and the significant risk of such jitter being induced into the observatory. The low power requirements of antenna systems 20 and 20' make these antenna systems excellent choices for use on a spacecraft having strict power limitations that would disqualify the use of antenna systems that use high-power amplifiers such as traveling-wave tube amplifiers.

The preceding description of the disclosed embodiments is provided to enable any person skilled in the art to make or use the present invention. The embodiments were chosen and described in order to best explain the principles of the invention and its practical applications. Various modifications to these embodiments will readily be apparent to those skilled in the art, and the generic principles defined herein may be applied to other embodiments without departing from the spirit or the scope of the invention. Thus, the present invention is not intended to be limited to the embodiments shown herein but is to be accorded the widest scope consistent with the following claims and the principles and novel features disclosed herein. Any reference to claim elements in the singular, for example, using the articles "a", "an" or "the" is not to be construed as limiting the element to the singular.

What is claimed is:

1. An antenna system comprising:

a single axis rotational turntable connected to a spacecraft by a support platform, with the turntable including means for rotating said support platform and means for providing provides increased stability as compared to conventional high gain antennas that uses a two-axis-gimbal pointing system supported by a boom;

a curved reflector attached to the support platform, the curved reflector including a reflector surface having a perturbed paraboloid geometrical shape that reflects RF microwave energy along a beam peak pointing direction, the reflector surface reflecting most of the RF microwave energy towards the earth's surface in such a manner that the reflected RF microwave energy illuminates a narrow strip of the earth's surface from nadir to a point near the earth's horizon with substantially constant intensity; and an offset feed horn attached to the support platform to transmit RF microwave energy toward the reflector surface, the offset feed horn being oriented and positioned such that it points away from said beam peak pointing direction;

whereby the reflector surface is curved to project the illumination intensity on the earth's surface as substantially constant along a narrow strip from nadir to a point close to the horizon with a predetermined contour pattern containing a 4 dB margin along a center line of an illuminated strip with a radial coordinate representing predetermined measurement units from nadir on the earth's surface and an angular coordinate representing the azimuth angle with a substantial portion of the radiation energy emanating from the feed horn diverted towards the areas near the horizon with pattern levels drops away causing "fan-shaped" beams with one end much stronger and directed towards the horizon and the weaker end directed towards nadir;

whereby the feed horn includes a horn section and a polarizer section and further comprises two half sections removably attached together with a polarizer fin sandwiched between feed horn sections; and the antenna system further including dual isolated waveguides, isolated to minimize energy coupling from one waveguide port to the other, whereby a first waveguide port produces right-hand circular polarization (RHCP) and a second waveguide port produces left-hand circular polarization (LHCP).

2. The antenna system according to claim 1 further comprising a support post attached to the support platform, wherein the reflector is attached to the support post.

3. The antenna system according to claim 1 further comprising a support post attached to the support platform, wherein the offset feed horn is attached to the support post.

4. The antenna system according to claim 1 wherein the offset feed horn includes a load termination device.

5. The antenna system according to claim 1 wherein the offset feed horn includes an internal waveguide and comprises a pair of feed horn sections that are connected together, each feed horn section defining a portion of the internal waveguide.

6. The antenna system according to claim 1 wherein one of the feed horn sections has a stepped recess sized for receiving the polarizer fin.

7. The antenna system according to claim 1 further comprising a feed waveguide connected to the offset feed horn to provide RF microwave energy to the feed horn.

8. The antenna system according to claim 1 wherein the reflector surface is fabricated from metal.

9. The antenna system according to claim 1 wherein the reflector is fabricated from a thermally stable, electrically conducting composite material.

* * * * *